United States Patent [19]

Jankiewicz

[11] 4,317,095

[45] Feb. 23, 1982

[54] MILLI-VOLT SWITCHING DEVICE

[76] Inventor: Walter J. Jankiewicz, 3719 Mount Blackburn Ave., San Diego, Calif. 92111

[21] Appl. No.: 138,009

[22] Filed: Apr. 7, 1980

[51] Int. Cl.[3] ..... H01H 53/015

[52] U.S. Cl. ..... 335/149; 335/150; 335/195; 324/143; 324/157; 324/151 A

[58] Field of Search ..... 335/136, 147, 16, 80, 335/81, 100, 195, 223, 225, 187, 148, 149, 150; 200/147, 276, 279; 324/103 P, 114, 143, 151, 157; 336/130, 131

[56] References Cited

U.S. PATENT DOCUMENTS 2,398,651 4/1946 Lamb ..... 335/148 X 2,750,461 6/1956 Bunch ..... 335/147 X

FOREIGN PATENT DOCUMENTS 139476 11/1920 United Kingdom ..... 335/149

*Primary Examiner*—L. T. Hix
*Assistant Examiner*—S. D. Schreyer
*Attorney, Agent, or Firm*—Duane C. Bowen

[57] ABSTRACT

A switching device, with a mechanism similar to that of a D'Arsonval galvanometer, acting responsive to current flow in a primary control circuit to close a switch in a secondary controlled circuit. The primary control circuit includes dual oppositely wound coils, and relative pivotal mounting is provided between the coils and permanent magnets. The pivotal movement therebetween, upon current flow, closes the switch.

9 Claims, 8 Drawing Figures

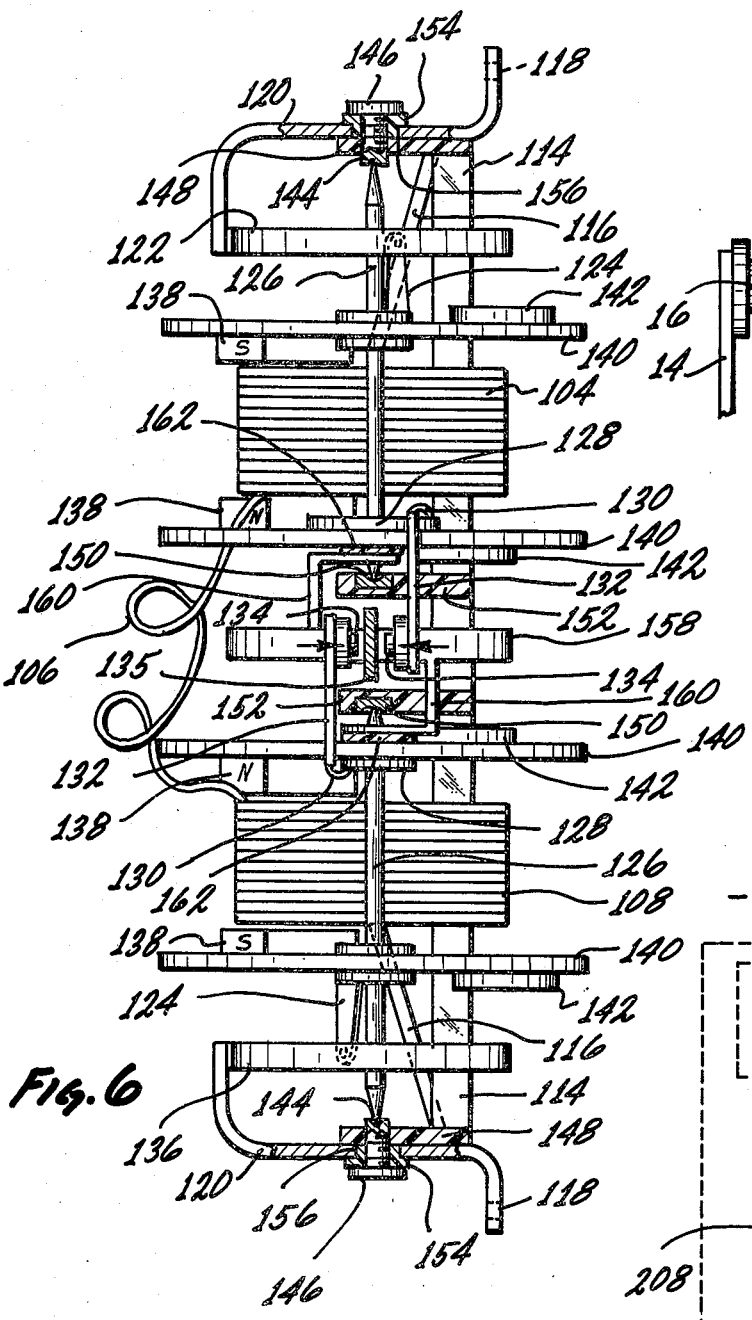
Fig. 6
Fig. 7
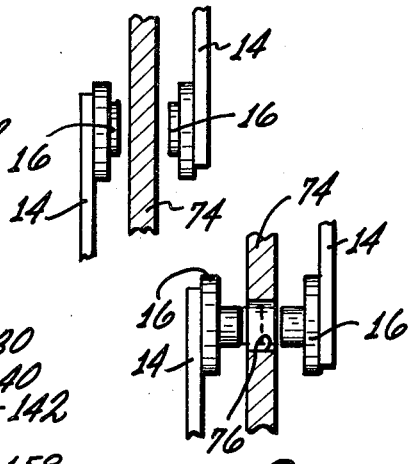
Fig. 8
Fig. 4
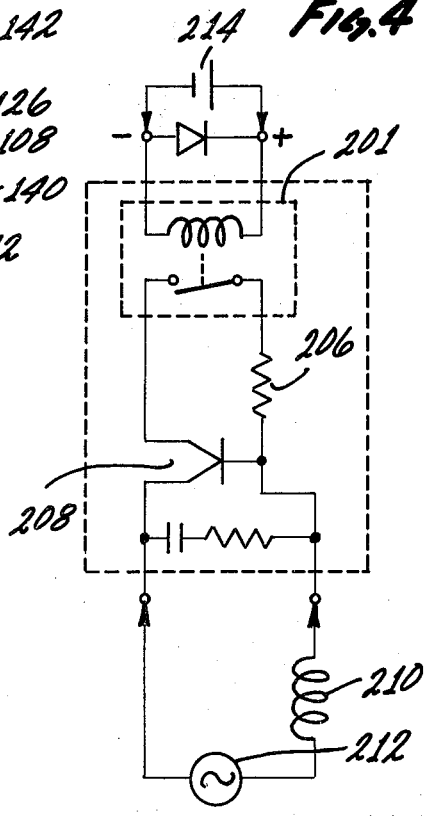

MILLI-VOLT SWITCHING DEVICE

BRIEF SUMMARY OF THE INVENTION

Background and Objectives

My invention relates to a switching device having an operating mechanism partly similar to that of a D'Arsonval galvanometer.

In some switching applications, wherein a switch is to be closed in a secondary controlled circuit responsive to current or voltage in a primary control circuit, switching needs to be sensitive to minor current flows or voltages. It is an objective of my invention to provide such a switching apparatus responsive to minor current flows or voltages.

The D'Arsonval galvanometer is known to be sensitive to minor current flows or voltages. It is an objective of my invention to devise a switching apparatus with a mechanism partly similar to that of a D'Arsonval galvanometer.

A further objective is to provide a sensitive switching device or relay that could replace many solid state switching circuits that must be "on" in order to function, thereby conserving power. Another objective is to provide a switching device that would not be accidentally energized when subjected to extreme external physical shock or vibration.

DRAWINGS

FIG. 4 is similar to FIG. 3 except there is alternating current power to the circuit.

FIG. 6 is a view partly in section taken on line 6—6 of FIG. 5.

FIG. 7 is an enlarged, fragmentary view partly in section of of electrical contacts in my switching device.

FIG. 8 is like FIG. 7 but with modified electrical contacts.

My invention will be best understood, together with additional objectives and advantages thereof, from the following description, read with reference to the drawings, in which:

DESCRIPTION

Figure 1:
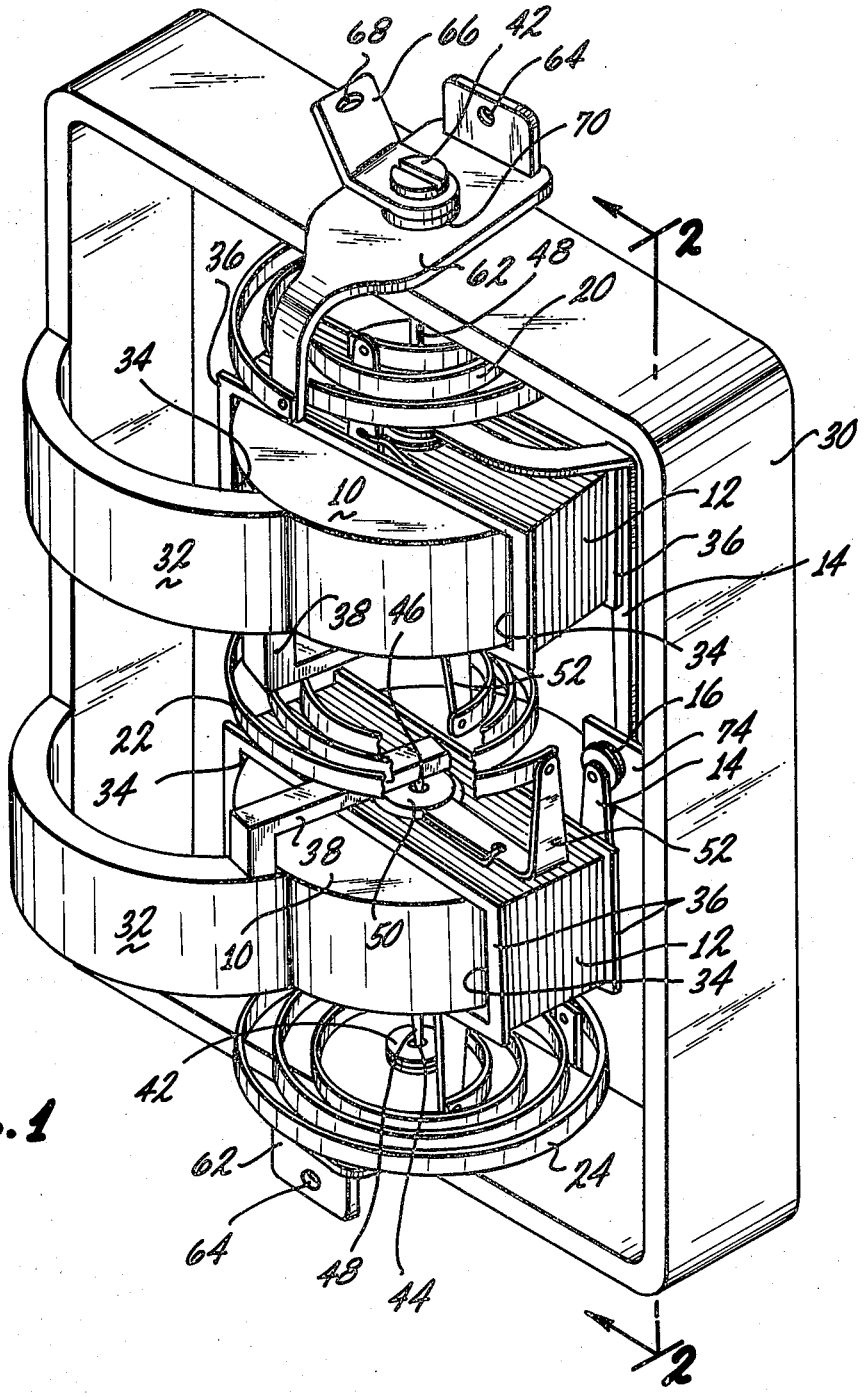
FIG. 1 is a perspective view of a specific embodiment of my new switching device.
Figure 2:
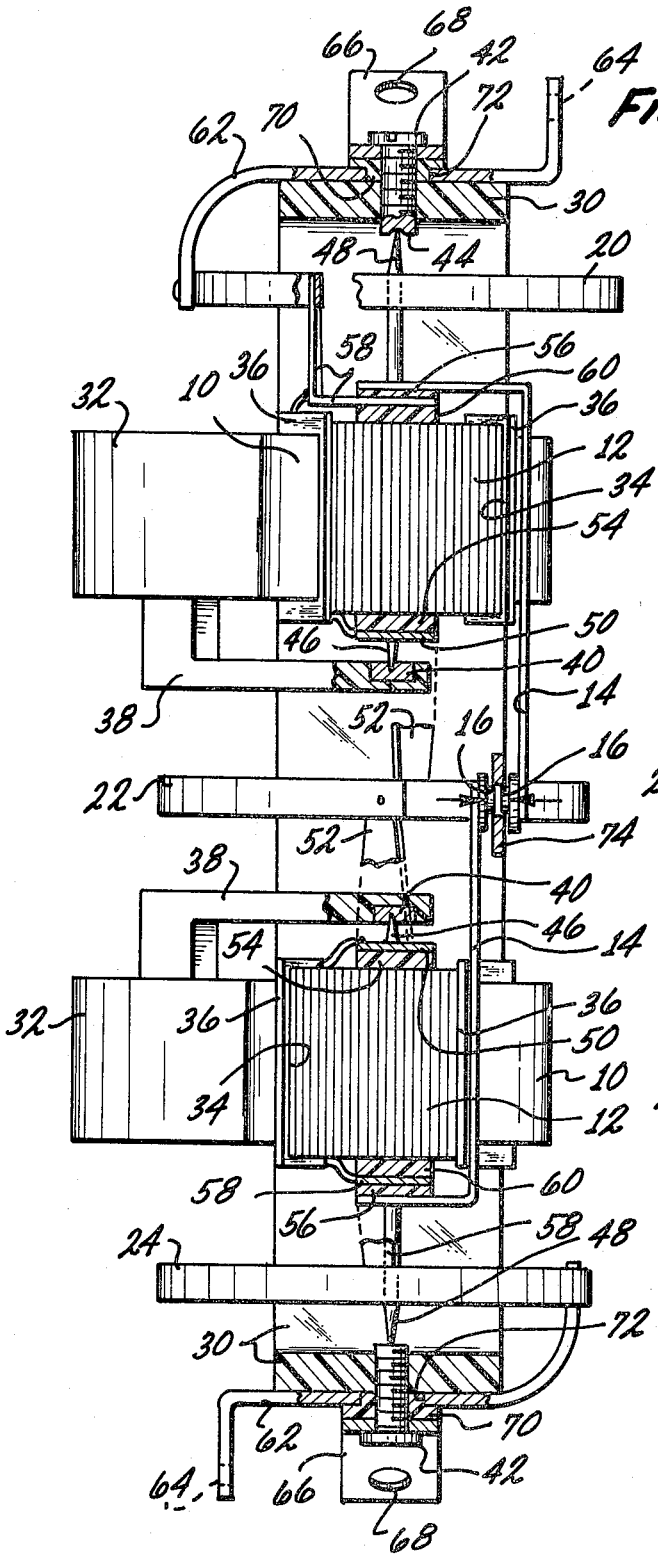
FIG. 2 is a view partly in section taken on line 2—2 of FIG. 1.

I will first describe the apparatus shown in FIGS. 1 and 2. Two permanent magnets 10 and two coils 12 are provided that are relatively pivotally mounted. When a force is created between the magnetic field of the permanent magnets 10 and a magnetic field created by passing a current through coils 12, then there is relative pivotal movement between magnets 10 and coils 12.

Coils 12 have arms 14 secured thereto that have contacts 16. Coils 12 are wound in opposite directions so that when viewed from above, in plain view, one coil 12, arm 14, and contact 16 pivots clockwise and the other coil 12, arm 14 and contact pivots counterclockwise. When current passes through coils 12 they move in directions tending to close contacts 16.

If current is passed through coils 12 as part of a primary controlled circuit, contacts 16 can be moved to effect electrical contact therebetween to thereby close the switch formed therebetween in a secondary controlled circuit.

Springs are used normally to hold the coils 10 with the contacts 16 apart. These springs include upper, medial and lower horizontally coiled springs 20, 22, 24.

The foregoing indicates the relationships of principal functioning parts in FIGS. 1 and 2. I will now describe the construction of the specific embodiment in more detail.

A convenient support for the working parts can be provided by a rectangular frame 30 that may be formed of plastic. Permanent magnets 10 may be solid iron cylinders with the holes arranged N-S, N-S or S-N, S-N vertically from top to bottom as viewed. Arms 32 supporting magnets 10 in cantilevered manners from frame 30 may be plastic and arms 32 may be secured by being bonded to each.

The wire of each coil 12 preferably is supported by winding about an aluminum support 34 that is box-shaped in the sense of having top, bottom and two ends and which has flanges 36 to retain the wire in place. Magnets 10 are generously housed inside aluminum boxes 34 so that relative movement therebetween is accommodated.

Coils 12 and aluminum boxes 34 are mounted to pivot about preferably a common axis which is viewed as a vertical axis. Medial supports for pivotal mounting are plastic L-shaped arms 38 which can be part of or bonded to arms 32. Inset into the ends of arms 38 are ruby bearing seats 40. Top and bottom supports for pivotal mounting are bolts or screws 42 having seats 44 in their inner ends. Bolts 42 are threadedly engaged openings in plastic frame 30. Medial needle-nosed spindles 46 engage seats 40 and upper and lower needle-nosed spindles 48 engage seats 44 in bolts 42 to thereby pivotally support coils 12. Upper and lower spindles preferably have gold-plated ends and seats 44 in bolts 42 preferably are gold-plated for best conductivity.

Spindles 48 can be soldered to the inner ends of arms 14. Spindles 46 can be soldered to or formed as a part of discs 50 at the inner ends of L-shaped arms 52 that are attached to the ends of medial spring 22. L-shaped arms 52 and discs 50 can be bonded to an insulating pad 54 which is suitably bonded to coil 12 for support of spring 22 and spindles 46. Spindle 48 and arm 14 are bonded to an insulating pad 56 which is bonded to an L-shaped arm 58 that supports an end of spring 20 or 22. Arm 58 is bonded to an insulating pad 60 which is suitably bonded to coil 12 for support of spindle 48 and spring 20 or 22. The other ends of springs 20, 24 are supported by arms 62 that have openings 64 at their outer ends for electrical connection thereto. Coils 66 also have openings 68 for electrical connection thereto. Clips 66 are insulated from arms 62 by insulating washer pads 70 through which bolts 42 extend. Washer pads 70 can have two diameters, a larger diameter to fit between clips 66 and arms 62 and a smaller diameter to fit in bores 72 in arms 62.

The spacing between contacts 16 can be set in the process of bonding up the assembly between arms 14 and then contacts 16 can be properly located before the assemblies outside of arms 14 are secured by bolts 42. Plate 74, bonded to frame 30, separates contacts 16. One function of plate 74 is to limit swinging movements of contacts 16, arms 14 and coils 12 due to vibration, shocks, acceleration-deceleration, etc., of the environment of the switching device, which could be in a vehicle or otherwise be subject to forces that would tend to give excessive swinging movement from neutral position and would overcome the tendency of springs 20–24 to hold contacts 16 in neutral position. The abutment function of plate 74 would not be needed if the switching device were in an absolutely stable, static environment as to outside forces.

The second function of plate 74 is as a conductor between contacts 16, in which case plate 74 and contacts 16 may be gold-plated or otherwise treated for good electrical contact. In the version of plate 74 and contacts 16 seen in FIG. 7, plate 74 acts as a motion limiting abutment and as a conductor therebetween when forces act to move contacts in directions towards each other. In the modified version of plate 74 shown in FIG. 8, contacts 16 directly meet through a bore 76 through plate 74. The dashed lines in FIG. 8 represent the condition in which forces act to move contacts 16 together. In the FIG. 8 construction, plate 74 acts only as an abutment and not as a conductor between contacts 16, hence plate 74 could be of plastic rather than metal or a different type of motion-limiting abutment or stop could be used.

An example would be normally 1/16" spacing between contacts 16 in FIG. 8 or between each contact 16 and the faces of the plate 70 and contacts 16 in FIG. 7.

Note that coils 12 normally do not tend to pivot relative to each other, i.e., they are pivotally mounted with spring 22 therebetween and would tend to pivot together about their common vertical pivotal axis when the switching device is subjected to external forces like acceleration. Thus, when coils 12 have some movement due to external acceleration-deceleration forces, they tend to swing together and contacts 16 have substantially the same spacing as in static, stable conditions.

Contact is made between contacts 16 when they are forced toward each other due to interaction of the magnetic fields of permanent magnets 10 and of the magnetic fields created by coils 12 when current is passed therethrough. Coils 12 have to be wound in directions so that when current passes therethrough one coil moves clockwise and the other coil moves counterclockwise as seen in plan view from above in directions so that contacts 16 will tend to move toward each other against the resistance of coils 20, 24 and as permitted by the connection therebetween of spring 22. The amperage or voltage of current going through coils 12 will determine whether the force of the magnetic fields of coils 12 is strong enough to overcome the forces of springs 20–24 sufficiently to close contacts 16.

The primary controlling circuit in FIGS. 1 and 2 passes from top to bottom as follows: from a conductor connected to opening 64, through upper arm 62, through upper spring 20, through L-shaped arm 58, to upper coil 12 (which has an end connection to arm 58), to upper L-shaped arm 52 (which is connected to an end of upper coil 12), through medial spring 22, through lower L-shaped arm 52 (which is connected to one end of lower coil 12), to lower L-shaped arm 58 (which is connected to the other end of lower coil 12), through lower spring 24, through lower arm 62, to a conductor connected to opening 64.

The secondary controlled circuit in FIGS. 1 and 2 passes from top to bottom as follows: from a conductor connected to opening 68 of upper clip 66, through upper bolt 42, through upper spindle 48, through upper arm 14, past contacts 16 when they are in contact directly (FIG. 8 construction) or through the intermediate plate 74 (FIG. 7 construction), through lower arm 14, through spindle 48, through bolt 14, through lower clip 66, and to a conductor connected to opening 68.

Figure 5:
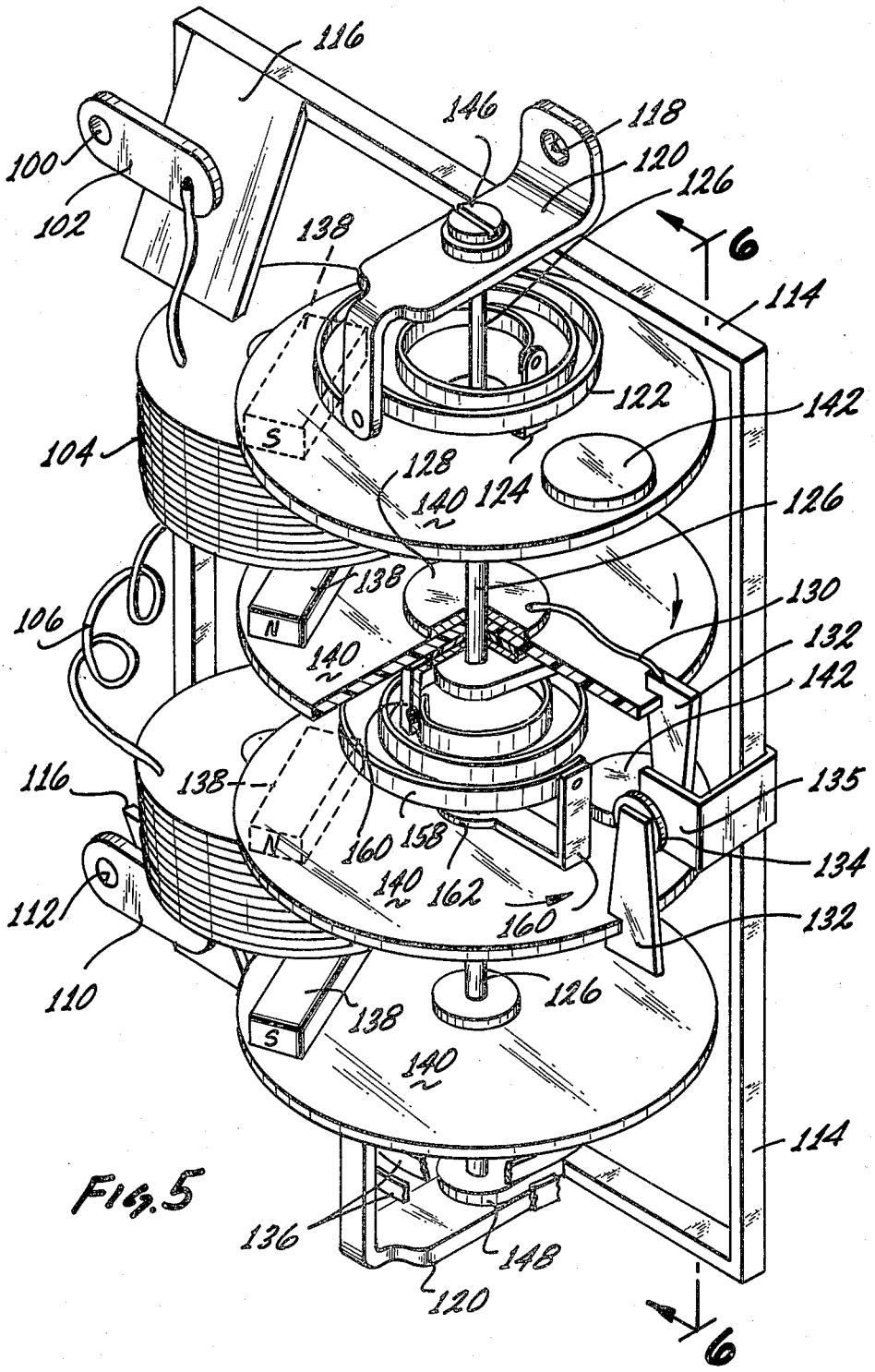
FIG. 5 is a view like FIG. 1 but of a modified version of my switching device.

I will now describe the construction shown in FIGS. 5 and 6. The primary controlling circuit is from a conductor connected to opening 100 of upper clip 102. One end of upper coil 104 is connected to clip 102. Conductor 106 connects upper coil 104 and lower coil 108. The other end of lower coil 108 connects to lower clip 110 that has an opening 112 to which another conductor of the controlling circuit is connected. Coils 104, 108 are supported from plastic frame 114 by arms 116 bonded to each other.

Secondary controlled circuit, from top to bottom, starts with a conductor connected to opening 118 of upper arm 120, to upper horizontally coiled spring 122, through upper L-shaped arm 124, through upper middle 126, through metal disc 128, through wire 130, to upper arm 132, through contacts 134 (directly or through the plate 135 supported on frame 114) when the contacts are closed, to the lower arm 132, through lower wire 130 and disc 128 to lower spindle 126, through lower L-shaped arm 124, through lower spring, to lower arm 120, to a conductor connected to lower opening 118.

Permanent magnets 138 are supported on four superposed plastic discs 140 pivotally mounted in pairs on upper and lower spindles 126. Counterbalancing weights 142 are mounted on discs 140 oppositely to magnets 138. The upper end of upper spindle 126 and the lower end of lower spindle 126 are pivotally mounted in seats 144 of bolts 146 threadedly engaged in mounting flanges 148 secured to or forming a part of frame 114. The lower end of upper spindle 126 and the upper end of lower spindle 126 are pivotally mounted in ruby bearing seats 150 inset in arms 152 attached to frame 114.

A dual diameter plastic washer 154 fits in a bore 156 in arm 120 and receives bolt 146. A medial horizontally coiled spring 158 is supported by upper and lower L-shaped arms 160 attached at one end to spring 158 and secured at the other end to the central spindle, disc structure, as by bonding to plastic washers 162 interposed between arms 160 and discs 140.

In FIGS. 5 and 6 the function of pivotal mounting of magnets 138 by discs 140, spindles 126, etc., is comparable to the pivotal mounting of coils 12 in FIGS. 1 and 2, and the functions of springs 122, 158, 136 in FIGS. 5 and 6 are comparable to the functions of springs 20, 22, 24 in FIGS. 1 and 2.

It will be understood in FIGS. 5 and 6 that current applied to coils 104, 108 will produce magnetic fields arranged relative to the magnetic fields of permanent magnets 138 to produce movement overcoming resistance of springs 122, 158, 136 to move upper arm 132 clockwise and lower arm 134 counterclockwise (as viewed from above), provided the applied current and voltage is of sufficient magnitude. The directions of winding of coils 104, 108 or the arrangements of the poles of magnets 138 are, of course, important in determining the directions of movement of arms 132. The relationships of contacts 134 to plate 135 are the same as explained in connection with FIGS. 7 and 8 relative to contacts 16 and plate 74.

Magnets 158 are illustrated in FIGS. 5 and 6 to show, from the top, an upper pair of poles arranged S-N and a lower pair of poles arranged N-S. Interposed between these pairs of poles are coils 104, 108 and, of course, their magnetic fields when the coils are energized. The closer the pairs of magnets 138 are to coils 104, 108 the better, as long as there is sufficient clearance for movement of the magnets.

Limited tests have indicated the configuration of FIGS. 5 and 6 to be superior to the configuration of FIGS. 1 and 2 as to certain consideration, but a principal advantage of the FIGS. 1 and 2 configuration is that it can have a smaller envelope, all other factors being equal. My switching device can be quite small, i.e., the vertical height for some applications could be as low as one inch. The advantages of the FIGS. 5 and 6 configuration are due partly to the close proximity of coils 104, 108 to magnets 138 and are due partly to avoiding having the switching current pass through the spindles and their seats. Manufacturing cost could be less as to some balancing, assembly and other factors. In either configuration, the physical placement of the coils relative to the magnets should be as close as possible to take full advantage of the field generated by flow of current in the coils.

Precision balancing is very important. Manufacturing standards should be like those in quality watches. Although not illustrated, dust covers will be required as the device must be substantially dust free.

I will give an example of a procedure to adjust the spacing of contacts 16, which preferably normally will have a spacing of say, 1/16" on either side of plate 74 under static conditions. Adjustment is made after most of the other assembly is made but magnets 10 are not yet in place. Until arms 68 are secured by bolts 42, medial spring 22 will tend to force contacts 16 into abutment against abutment plate 74. Upper arm 62 is pivoted counterclockwise and lower arm is pivoted clockwise (as viewed from above in FIG. 1) against the resistance of medial spring 22, until the desired gap between contacts 16 is achieved, whereupon bolts 42 are tightened to secure arms 62 in position. Then magnets 10 are located within coils 12 to adjust the magnetic fields of the magnets to the locations of the magnetic fields of coils 12 when they are energized. Another way to adjust the gap between contacts 16 would be to bend arms 14 after the assembly is otherwise completed. Other details or alternatives in adjusting the gap between contacts 16 will be understood by those skilled in the art.

Figure 3:
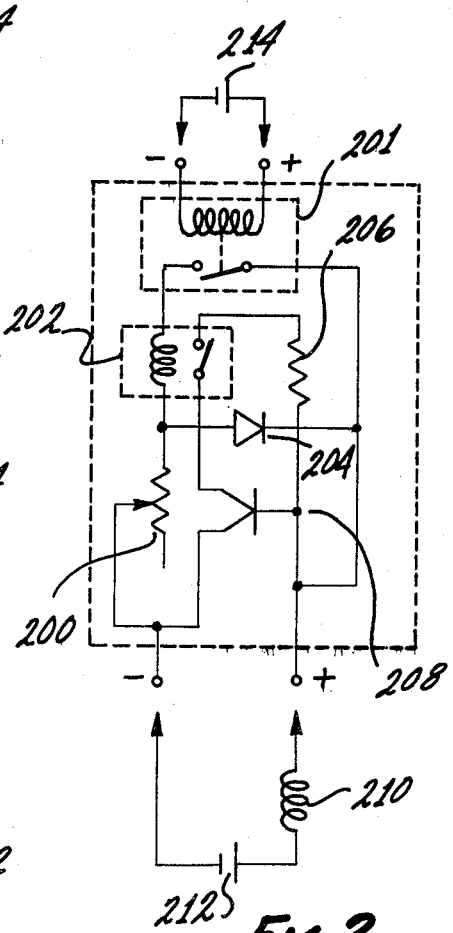
FIG. 3 is a diagram of a circuit used with my switching device with direct current power.

FIG. 3 shows a circuit diagram used to minimize arcing of contacts when a direct current load is used. Block 201 symbolizes my switching device. Coil current limiting resistor 200 is provided to limit the current to the operational value required for the coil in block 202 and its value is determined by the load voltage. A coil of 400 ohms would be an example. Block 202 includes a coil and a micro magnetic reed switch. Other elements of the FIG. 3 circuit include a diode 204, a gate current limiting resistor 206, a silicon control rectifier 208, a load 210, a load power supply 212 and a control voltage 214. FIG. 4 shows a circuit diagram, of partly similar components, when using alternating current loads. Proper selection should be made of the silicon rectifier 208 to determine the lowest gate current characteristic (in accordance with the load voltage) which preferably would not exceed 6 milli amp. The circuit functions of FIGS. 3 and 4 are well known, so they will not be discussed further.

Tentative specifications of an example of my new switching device are as follows:

1. Electrical characteristics:
   Control Voltages 0.015 v to 1.5 v
   Control Current 0.0000075 A to 0.00075 A
   Switching currents 0.014 to 0.021 A Block 202 FIG. 3
   Holding current through contact 0.06 A Block 201 FIG. 4
2. Absolute maximum rating:
   Continuous load 280 v AC or DC
   Maximum surge current 30 A peak
   Maximum control voltage 1.5 v
3. Switching coil current limiting resistor values (see 200 of FIG. 3) for following loads (Caution: ensure proper resistor is in place prior to applying DC load.)

| Load | Resistor | Coil current |
|---|---|---|
| 5v to 7.5 vdc | 0 ohms | .014 to .021 A |
| 12 vdc | 400 ohms | .016 A |
| 24 vdc | 1000 ohms | .017 A |
| 36 vdc | 1700 ohms | .017 A |
| 48 vdc | 2500 ohms | .016 A |
| 60 vdc | 3200 ohms | .016 A |
| 84 vdc | 4700 ohms | .016 A |
| 110 vdc | 6000 ohms | .017 A |
| 220 vdc | 12000 ohms | .017 A |
| 280 vdc | 16000 ohms | .017 A |

4. Control current values at 0.015 v to 1.5 v with 1/64" inch gap with 1000 ohms for each relay coil.

| Voltage | Current |
|---|---|
| 1.5 v | .00075 A |
| 1.0 v | .00050 A |
| 0.42 v | .00021 A |
| 0.374 v | .000187 A |
| 0.332 v | .000166 A |
| 0.3 v | .000150 A |
| 0.2 v | .000100 A |
| 0.08 v | .000040 A |
| 0.06 v | .000030 A |
| 0.05 v | .000025 A |
| 0.015 v | .0000075 A |

Double current values if relay coils are 500 ohms each.

Having thus described my invention, I do not want to be understood as limiting myself to the exact details shown and described herein. Instead I wish to cover those modifications thereof which will occur to those skilled in the art who learn of my disclosure and which are properly within the scope of my invention.

I claim:

1. A switching device acting responsive to initiating of current flow in a primary control circuit to close a switch in a secondary controlled circuit, comprising:

(a) magnetic means forming a magnetic field, (b) said primary control circuit including coil means disposed in said magnetic field whereby a force is created between said coil means and said magnetic field when current flow is initiated in said primary control circuit, (c) said magnetic means and said coil means being relatively pivotally mounted so that one of said means can pivotally move responsive to said force and said one means having switching means operative to close said switch upon such pivotal movement, (d) spring means acting on said one means resisting pivotal movement of said one means to close said switch, said spring means being of a strength to be overcome by said force when current flows in said primary control circuit, (e) said one means being said coil means, (f) said magnetic means including a pair of fixed, superposed permanent magnets and said coil means including a pair of coils each wound about one of said magnets in a spaced manner so as not to prevent pivotal movement therebetween, (g) pivotal support means pivotally supporting each coil above and below to pivot about a common vertical axis extending generally centrally of said coils and of said magnets, and (h) said spring means including three horizontally coiled springs generally centered on said vertical axis, one spring being located above the upper coil, one spring being located below the lower coil, and one spring being located between the coils and the springs being attached to the coils in a manner resisting movement to close said switch, said springs being included in said primary control circuit to carry current to said coils.

2. A switching device acting responsive to initiating of current flow in a primary control circuit to close a switch in a secondary controlled circuit, comprising:

(a) magnetic means forming a magnetic field, (b) said primary control circuit including coil means disposed in said magnetic field whereby a force is created between said coil means and said magnetic field when current flow is initiated in said primary control circuit, (c) said magnetic means and said coil means being relatively pivotally mounted so that one of said means can pivotally move responsive to said force and said one means having switching means operative to close said switch upon such pivotal movement, (d) spring means acting on said one means resisting pivotal movement of said one means to close said switch, said spring means being of a strength to be overcome by said force when current flows in said primary control circuit, (e) said one means being said coil means, (f) said magnetic means including a pair of fixed, superposed permanent magnets and said coil means including a pair of coils each wound about one of said magnets in a spaced manner so as not to prevent pivotal movement therebetween, (g) pivotal support means pivotally supporting each coil above and below to pivot about a common vertical axis extending generally centrally of said coils and of said magnets, (h) said switching means including in said secondary controlled circuit a pair of contact arms each secured to one of said coils and insulated therefrom, one contact arm depending from the upper coil and one contact arm being upstanding from the lower coil and said contact arms being normally held apart by said spring means, said coils being wound relative to said permanent magnets so that one pivots clockwise and one pivots counterclockwise in plan view under the force caused by current flow through said coils so that said spring means is overcome and said contact arms move toward each other to close said switch, and (i) a conductive body located between said contact arms to that electrical contact is made therebetween by said contact arms pressing on opposite faces of said body, said body acting as an abutment to limit swinging movement of said contact arms and coils due to external forces acting on the switching device.

3. A switching device acting responsive to initiating of current flow in a primary control circuit to close a switch in a secondary controlled circuit, comprising:

(a) magnetic means forming a magnetic field, (b) said primary control circuit including coil means disposed in said magnetic field whereby a force is created between said coil means and said magnetic field when current flow is initiated in said primary control circuit, (c) said magnetic means and said coil means being relatively pivotally mounted so that one of said means can pivotally move responsive to said force and said one means having switching means operative to close said switch upon such pivotal movement, (d) spring means acting on said one means resisting pivotal movement of said one means to close said switch, said spring means being of a strength to be overcome by said force when current flows in said primary control circuit, (e) said one means being said coil means, (f) said magnetic means including a pair of fixed, superposed permanent magnets and said coil means including a pair of coils each wound about one of said magnets in a spaced manner so as not to prevent pivotal movement therebetween, (g) pivotal support means pivotally supporting each coil above and below to pivot about a common vertical axis extending generally centrally of said coils and of said magnets, (h) said switching means including in said secondary controlled circuit a pair of contact arms each secured to one of said coils and insulated therefrom, one contact arm depending from the upper coil and one contact arm being upstanding from the lower coil and said contact arms being normally held apart by said spring means, said coils being wound relative to said permanent magnets so that one pivots clockwise and one pivots counterclockwise in plan view under the force caused by current flow through said coils so that said spring means is overcome and said contact arms move toward each other to close said switch, and (i) a body located between said contact arms acting as an abutment to limit swinging movement of said contact arms and coils due to external forces acting on the switching device, said contact arms having opposed contact fingers on their adjacent portions and said body having an opening therethrough whereby said contact fingers of said arms can make electrical contact through said openings.

4. A switching device acting responsive to initiating of current flow in a primary control circuit to close a switch in a secondary controlled circuit, comprising:

(a) magnetic means forming a magnetic field, (b) said primary control circuit including coil means disposed in said magnetic field whereby a force is created between said coil means and said magnetic field when current flow is initiated in said primary control circuit, (c) said magnetic means and said coil means being relatively pivotally mounted so that one of said means can pivotally move responsive to said force and said one means having switching means operative to close said switch upon such pivotal movement, (d) spring means acting on said one means resisting pivotal movement of said one means to close said switch, said spring means being of a strength to be overcome by said force when current flows in said primary control circuit, (e) said one means being said magnetic means, and (f) a pair of vertically spaced fixed coils, a pair of pivotal mounts above and below each coil and each pair of mounts supporting a superposed pair of permanent magnets above and below each coil thereby directing a magnetic field relative to each coil, each pair of mounts being pivotal about a vertical axis, whereby when current flows through said coils said magnets will be pivoted, said coils and magnets being arranged so that one pair of mounts will pivot clockwise and one pair of mounts will pivot counterclockwise in plan view under the force occasioned by initiation of current flow in said primary control circuit.

5. The subject matter of claim 4 in which said switching means includes a pair of contact arms each secured to one of said pairs of pivotal mounts, one contact arm depending from the upper of said pairs of pivotal mounts and the other contact arm being upstanding from the lower of said pairs of pivotal mounts, said contact arms being normally held apart by said spring means and said contact arms closing said switch in said secondary controlled circuit upon being moved toward each other under the force occasioned by initiation of current flow in said primary control circuit.

6. The subject matter of claim 5 in which said spring means includes three horizontally coiled springs, one spring being located above the upper pair of mounts, one spring being located below the lower pair of mounts, and one spring being located between the pairs of mounts and the springs being attached to the mounts in a manner resisting movement to close said switch by said contact arms, said upper and lower springs being included in said secondary controlled circuit.

7. The subject matter of claim 5 in which each pivotal mount is a disc and said discs are superposed to pivot about a common vertical axis, said magnets being mounted on said discs spaced from said vertical axis and said discs having counterweights disposed diametrically opposite to said magnets to balance the same.

8. The subject matter of claim 5 in which there is a conductive body located between said contact arms so that electrical contact is made therebetween by said contact arms pressing on opposite faces of said body, said body acting as an abutment to limit swinging movement of said contact arms and magnets due to external forces acting on the switching device.

9. The subject matter of claim 5 in which there is a body located between said contact arms acting as an abutment to limit swinging movement of said contact arms and magnets due to external forces acting on the switching device, said contact arms having opposed contact fingers on their adjacent portions and said body having an opening therethrough whereby said contact fingers of said arms can make electrical contact through said opening.

* * * * *